US008925273B2

(12) United States Patent
Huff

(10) Patent No.: US 8,925,273 B2
(45) Date of Patent: Jan. 6, 2015

(54) CLIPS FOR THIN BRICK WALL SYSTEM

(75) Inventor: Robert Huff, London (CA)

(73) Assignee: Quadrosera Corporation, London, Ontario (CA)

( * ) Notice: Subject to any disclaimer, the term of this patent is extended or adjusted under 35 U.S.C. 154(b) by 0 days.

(21) Appl. No.: 14/003,935

(22) PCT Filed: Mar. 8, 2012

(86) PCT No.: PCT/CA2012/000216

§ 371 (c)(1),
(2), (4) Date: Sep. 9, 2013

(87) PCT Pub. No.: WO2012/119239

PCT Pub. Date: Sep. 13, 2012

(65) Prior Publication Data

US 2014/0013697 A1 Jan. 16, 2014

Related U.S. Application Data

(60) Provisional application No. 61/450,676, filed on Mar. 9, 2011.

(51) Int. Cl.

| | |
|---|---|
| ***E04B 2/08*** | (2006.01) |
| ***E04B 1/61*** | (2006.01) |
| *E04B 2/02* | (2006.01) |

(52) U.S. Cl.

CPC ..... *E04B 2/08* (2013.01); *E04B 2002/0236* (2013.01); *E04B 1/6162* (2013.01)

USPC ..... 52/563; 52/386; 52/391; 52/568; 52/597; 52/699

(58) Field of Classification Search

CPC ..... E04B 2/08; E04B 1/6162; E04F 13/14; E04F 13/21; E04F 13/24; E04C 1/00

USPC ..... 52/378, 379, 386, 391, 422, 424, 427, 52/428, 513, 562–564, 568–571, 597, 52/698–700

See application file for complete search history.

(56) References Cited

U.S. PATENT DOCUMENTS

| | | | | | |
|---|---|---|---|---|---|
| 802,903 | A | * | 10/1905 | Anderson | 52/279 |
| 840,071 | A | * | 1/1907 | Lewis | 52/568 |
| 1,548,214 | A | * | 8/1925 | Schaefer et al. | 52/379 |
| 1,594,387 | A | * | 8/1926 | Stubbs | 52/606 |
| 1,831,565 | A | * | 11/1931 | Jagger | 52/700 |
| 1,975,759 | A | * | 10/1934 | Anderson et al. | 52/379 |
| 2,075,262 | A | * | 3/1937 | Boettner | 52/99 |
| 2,176,450 | A | * | 10/1939 | Barnett | 52/708 |
| 2,780,936 | A | * | 2/1957 | Hillberg | 52/710 |

(Continued)

FOREIGN PATENT DOCUMENTS

| | | | |
|---|---|---|---|
| CA | 2155825 | A1 | 9/1994 |
| CA | 2526876 | C | 5/2009 |
| CA | 2749337 | A1 | 8/2010 |
| EP | 0892125 | A2 | 1/1999 |
| GB | 2141156 | A | 12/1984 |

*Primary Examiner* — Adriana Figueroa

(57) ABSTRACT

A decorative wall system comprises a supporting wall, a thin brick element with a mortice formed therein and a dovetail tenon clip with fastening means for insertion and retention in the mortice whereby the brick element is attached to the supporting wall. The dovetail tenon clip has a longitudinal space to enable the sidewalls to be pressed inwardly to collapse the space.

8 Claims, 6 Drawing Sheets

(56) References Cited

U.S. PATENT DOCUMENTS

| | | | | | |
|---|---|---|---|---|---|
| 3,200,544 | A * | 8/1965 | Greek | 52/27 |
| 3,680,277 | A * | 8/1972 | Martin | 52/438 |
| 4,238,915 | A * | 12/1980 | Yoshida et al. | 52/510 |
| 4,881,348 | A * | 11/1989 | Davis | 52/127.7 |
| 5,277,009 | A * | 1/1994 | Yamaguchi et al. | 52/387 |
| 6,502,362 | B1 | 1/2003 | Zambelli et al. | |
| 8,234,828 | B2 * | 8/2012 | MacDonald | 52/391 |
| 2007/0151190 | A1 * | 7/2007 | Huff et al. | 52/592.5 |

* cited by examiner

CLIPS FOR THIN BRICK WALL SYSTEM

FIELD OF THE INVENTION

The present invention relates to thin brick decorative wall systems and to specialized tenon clips for fastening the thin brick elements to a load supporting wall or structure.

BACKGROUND OF THE INVENTION

Thin brick products are available in the marketplace. Typically, a regular brick is split longitudinally and the front facing portion is used. The remaining or back portion is discarded. When installed, an attractive natural brick appearance is presented. However, commercialization of this decorative wall facing option is slow in acceptance in part because of an inability to easily and inexpensively attach the facing brick elements to a vertical wall structure Typically in the art, thin stone or thin brick wall systems are installed by the so-called "lick and stick" method, which involves the use of epoxy adhesive to secure the thin stone or thin brick to plywood or OSB wall cladding, which involves the use of metal lath with a scratch coat of Portland mortar. Such an adhered thin stone or thin brick system is inherently less secure since improper application of the adhesive can lead to stones or bricks separating from the wall, which is both a nuisance and a safety problem. Such adhered thin stone or thin brick systems are typically only used in lower floor applications of residential and commercial buildings as there is a bias against their use on multi-floor buildings. Further, the adhered thin stone or thin brick system is not used in conjunction with other wall elements such as drainage board and weather-resistant wrap. Accordingly, thin stone or thin brick products have in the main been used primarily in commercial building applications.

Various bracket or clip systems have been developed to affix decorative veneer panels made to look like brick or stone to a vertical structural wall. Although useful in particular cases, such systems lack versatility and simplicity, requiring brackets or clips with complicated structures and/or several separate components. Such brackets or clips are difficult to secure to structural walls and require time-consuming alignment of panels. There remains a need in the art for a more versatile, secure and mechanically stronger thin stone or thin brick wall system that is less costly, easier and faster to install and requires less skilled labor.

SUMMARY OF INVENTION

According to one aspect of the invention, a decorative wall system comprises a supporting wall, a thin brick element with a mortise formed therein and a tenon clip having fastening means for insertion and retention in the mortise whereby the brick element is attached to the supporting wall.

According to another aspect of the invention, the tenon clip has a quadrilateral cross section comprising a fastening side having a first width, a second side having a width greater than the width of the first fastening side and sidewalls. The mortise has a cross section which is complementary to the tenon clip cross section and is sized to receive and retain the tenon clip therein.

According to yet another aspect of the invention, the tenon and mortise cross sections are dovetail shaped and the second side has a longitudinal space there between to enable the sidewalls to be pressed inwardly to collapse the space.

According to yet another aspect of the invention, the tenon clip has limiting means for engagement against the top surface of the brick element to thereby limit relative movement therebetween. The limiting means may consist of an integrally formed outwardly extending tab on the tenon clip.

According to yet another aspect of the invention, the fastening side has an outwardly protruding collapsible tab to permit selective engagement of the tenon clip against the supporting wall which is a trim feature which controls the space between the rear of the tenon clip and the supporting wall.

According to yet another aspect of the invention, a thin brick element having a decorative face, a top surface, a bottom surface, a thickness and a mortise aligned vertically and extending between the top and said bottom surfaces.

BRIEF DESCRIPTION OF THE DRAWINGS

In order that the invention may be more clearly understood, embodiments thereof will now be described in detail by way of example, with reference to the accompanying drawings, in which.

DESCRIPTION OF PREFERRED EMBODIMENTS

Figure 1A:
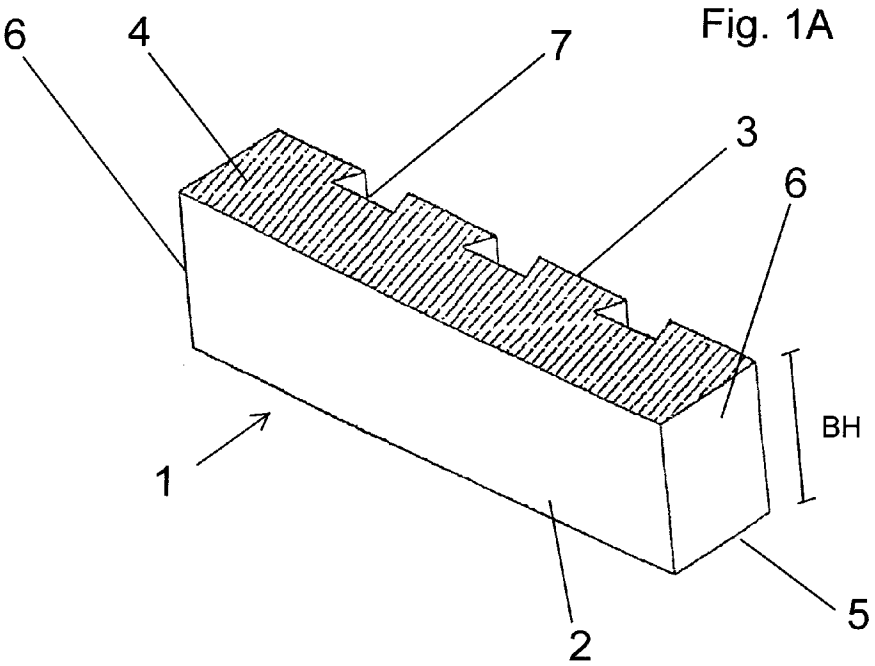
FIG. 1A is a perspective view of a thin brick facing element used in a decorative wall system of the present invention.
Figure 1D:
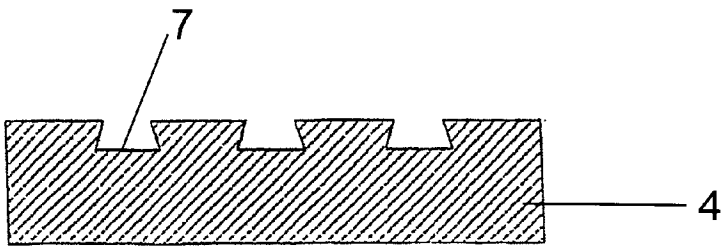
FIG. 1D is a side view of the thin brick element.
Figure 1B:
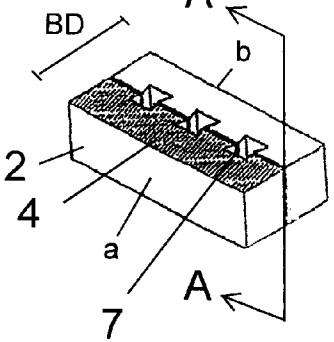
FIG. 1B is a perspective view of a regular brick showing how it may be split into two thin brick elements.
Figure 1C:
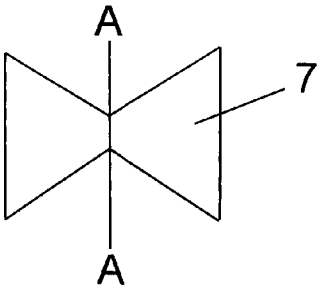
FIG. 1C is a cross sectional view of the dovetail shaped mortise aperture in FIG. 1B.

Referring to FIGS. 1A-1D, a thin brick element 1 comprises a front face 2, rear face 3, top face 4, bottom face 5 and two side faces 6. The thin brick element 1 is formed by splitting a standard brick longitudinally along line AA during the manufacturing process. The standard brick is manufactured with vertical dovetail shaped apertures (three apertures shown) along its centre as shown in FIGS. 1A and 1C. The splitting of the standard brick will leave a set of dovetail shaped aperture mortises along rear face 3 of the thin brick element 1. As well, it is preferable that both faces a and b of the thin brick element 1 are available for use so that the splitting of the regular brick will yield 2 thin brick elements which makes each thin brick element less costly.

A dovetail shaped mortise groove or slot 7 on the rear face 3 of a thin brick element 1 extends vertically along the entire brick height BH of thin brick element 1. The thin brick element 1 has the same dimension as a traditional brick with the exception of being only one half the traditional brick depth BD. In one embodiment the thin brick element 1, by way of example only, is approximately 7.625 inches long by 1.75 inches deep by 2.25 inches in height. The vertical dovetail shaped mortise 7 has a depth of approximately 0.75 inches with an opening width of between 0.75-1 inch and a bottom width of between 1-1.5 inches. The invention is not restricted to any particular brick or mortise size.

Figure 2:
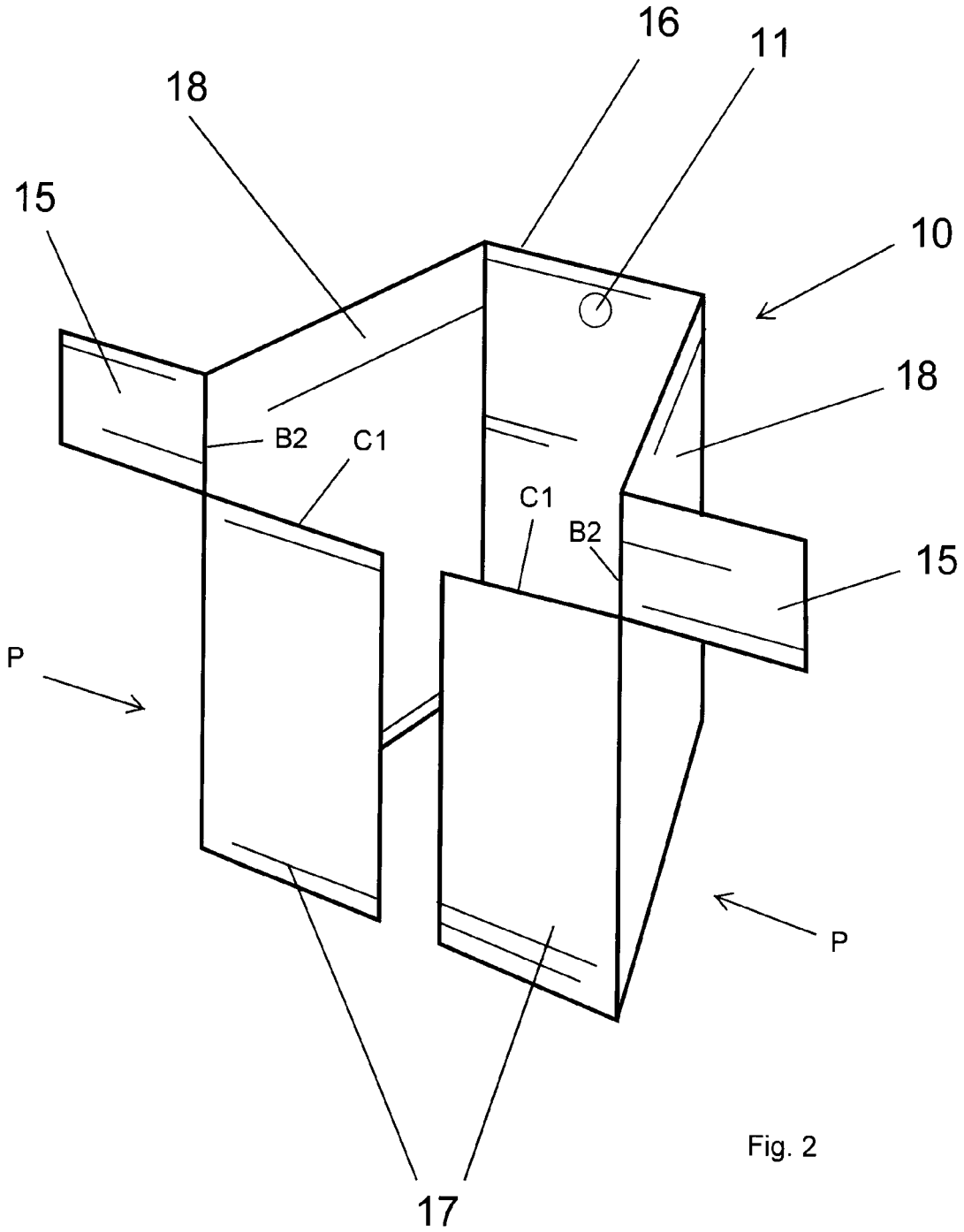
FIG. 2 is a perspective view of an embodiment of the tenon clip.
Figure 3:
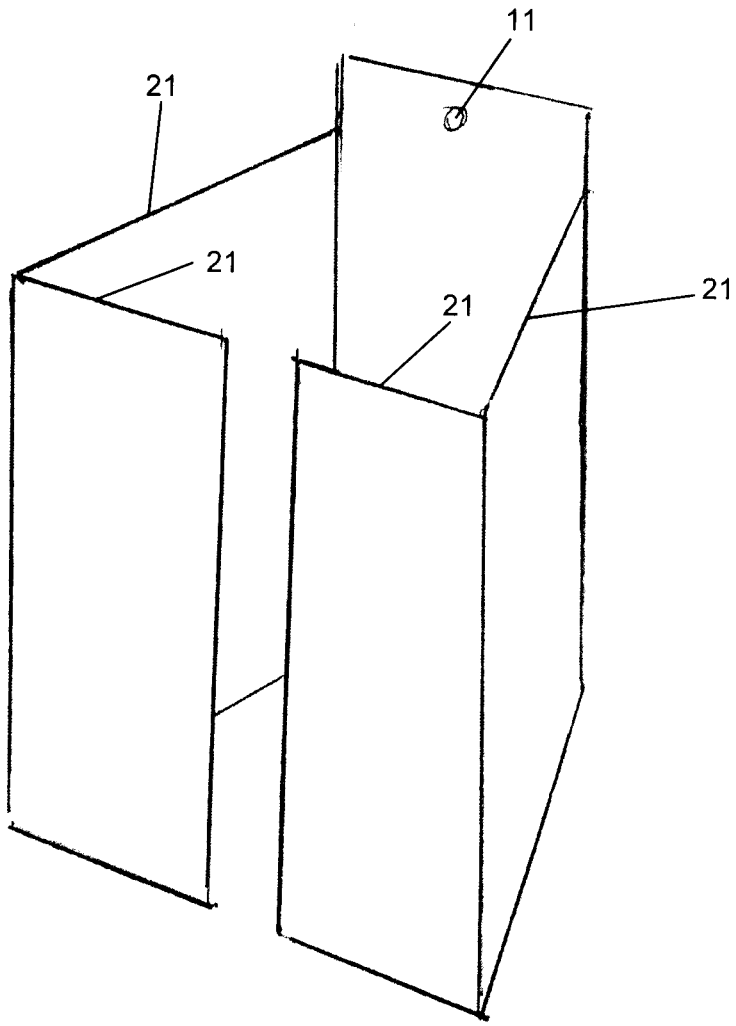
FIG. 3 is a perspective view of another embodiment of the tenon clip.
Figure 4:
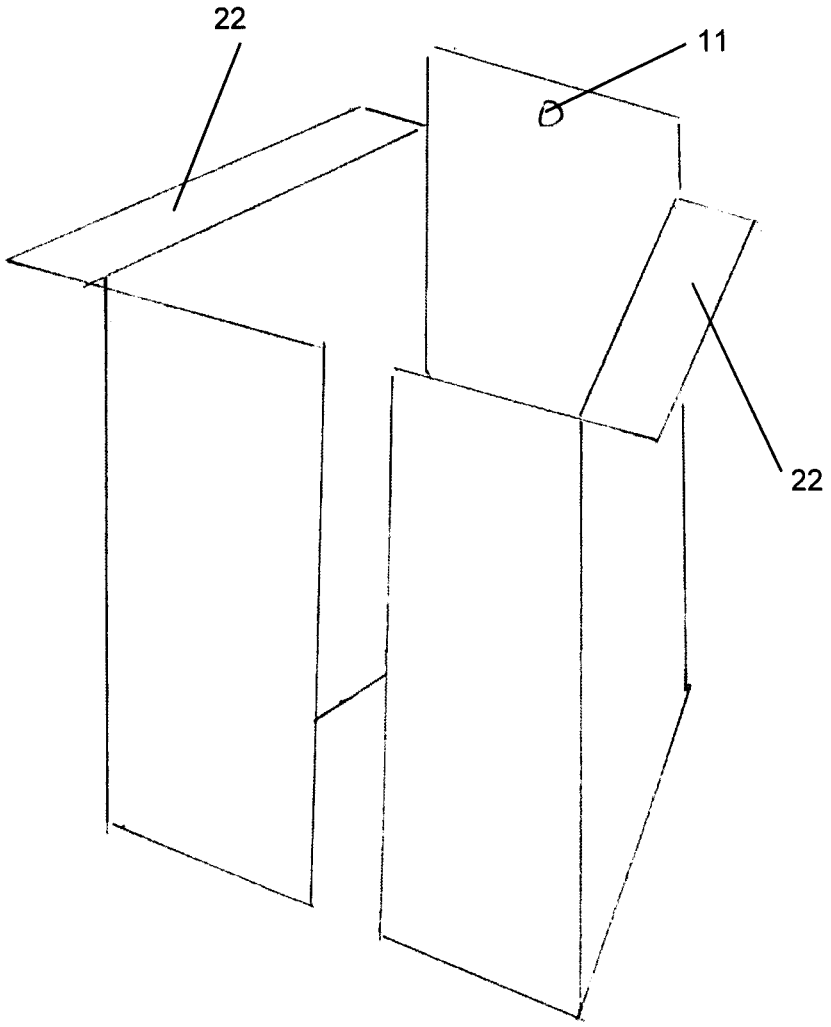
FIG. 4 is a perspective view of yet another embodiment of the tenon clip.

Referring to FIGS. 2-4, a dovetail tenon clip 10 is used for attaching the thin brick element 1 to plywood, drainage board or other vertical supporting structure. A dovetail joint is created by inserting the dovetail tenon clip 10 into the dovetail shaped mortise 7 which is securely retained therein. The dovetail tenon clip 10 acts as a flaring tenon and has a generally trapezoidal cross sectional shape. The tenon clip has a quadrilateral walled structure shape having opposing unequal parallel sides 16 and 17 to define the dovetail therebetween. The tenon clip has a shorter fastening side 16 having a first width, adjacent flared sides 18 having a length that flare outwardly, and split longer side portions 17 that are connected at the vertices and complete the trapezoid leaving an open space therebetween.

The space between the longer side 17 portions is provided to allow for a spring action to allow for easy insertion of the dovetail tenon clip 10 into the dovetail shaped mortise 7. The installer is thus able to apply finger pressure P on opposite sides of the tenon clip 10 to close the tenon clip enabling it to fit into the dovetail mortise 7 of the brick wherein it expands outwardly to fit snugly in the mortise and be retained and secured therein. The shorter fastening side 16 has an aperture 11 at the top for accepting a screw or nail or any other suitable fastening means, to fasten and secure the tenon clip 10 to the supporting structure. In this fashion the thin brick element 1 is firmly secured to the supporting structure. When the tenon clip 10 is installed into the thin brick element 1, the shorter fastening side 16 is preferably flush with the rear face 3 of the thin brick element 1.

Referring to FIG. 3, the tenon clip 10 has a top surface edge 21 which may be aligned flush with the top surface of the thin brick element 1. As such, the next upper row of bricks will rest directly on top of the bottom row in a dry stack arrangement with no space therebetween. To automate this type of installation, an engagement surface may be provided by way of outwardly extending tab 22 shown in FIG. 4. The tab 22 will automatically reference the tenon clip 10 with the top surface of the thin brick element 1 by limiting relative movement between the tenon clip 10 and brick element 1 at that point.

Alternatively, the top surface edge of the tenon clip 10 may be raised with reference to the top surface of the thin brick element 1 wherein the top row of bricks will rest directly on top of the top surface of the tenon clip 10 creating a mortar space therebetween.

Figure 6:
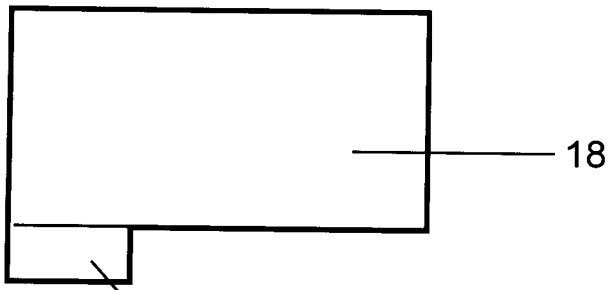
FIG. 6 is a side view of the tenon clip in FIG. 2.
Figure 5:
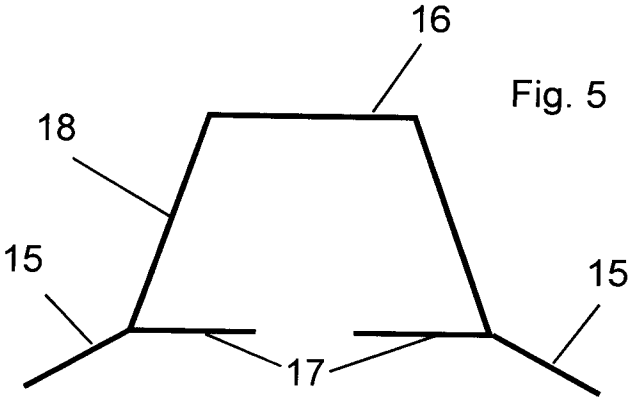
FIG. 5 is a top view of the tenon clip in FIG. 2.
Figure 7:
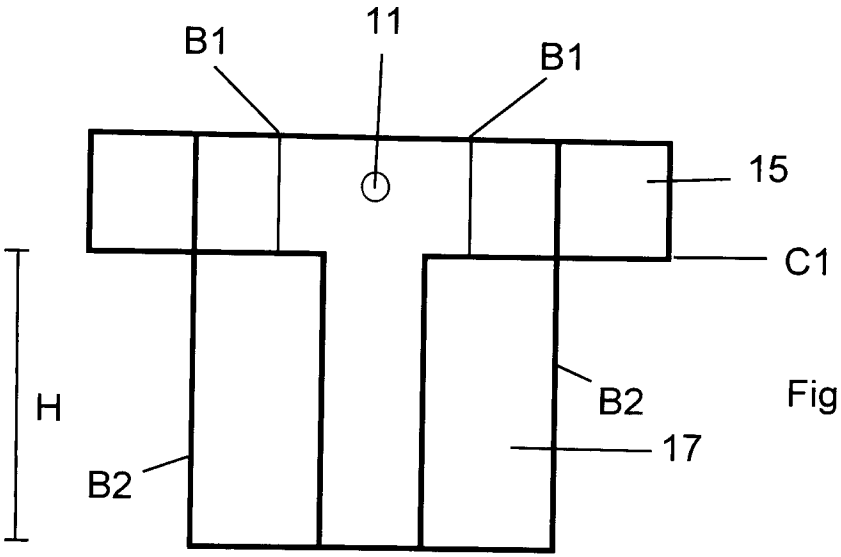
FIG. 7 is a front view of the tenon clip in FIG. 2.
Figure 8:
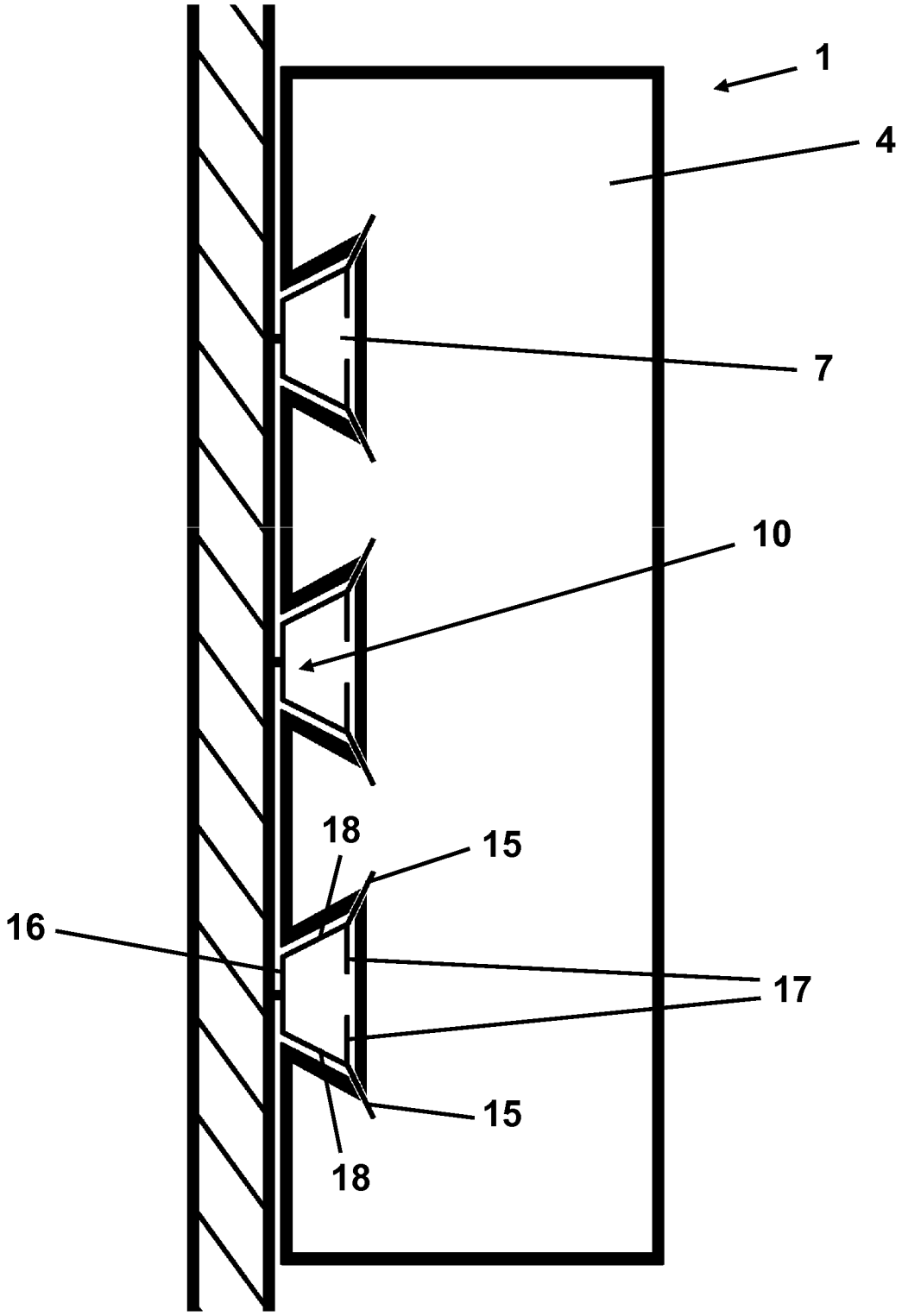
FIG. 8 is a top view of the thin brick element, tenon clip, and supporting wall surface of the decorative wall system of the present invention.

In another embodiment of the tenon clip 10, automatic spacing for mortar between vertically adjacent bricks is provided between the thin brick elements as shown in FIG. 2. The tenon clip 10 may be installed wherein a top portion thereof extends beyond the top surface of the brick to provide leveling, seating and importantly, define spacing distance between vertically adjacent bricks. Referring to FIGS. 5-7, the top portion of the split longer side 17 may be preferably cut away at a defined height H along line C1 to form a pair of wings or tabs 15 which when folded outwardly along line B2 engage the top surface of the thin brick element 1 when the tenon clip 10 is inserted into the dovetail mortise 7 to limit the relative movement between the tenon clip 10 and brick element and create automatic leveling and spacing between vertically adjacent thin brick elements 1. The entire top surface of the tenon clip 10 functions to provide a raised ledge to act as spacing and support for the next overlying brick.

Referring to FIGS. 2-4, it is to be noted that an aperture 11 is located in the fastening side portion of the tenon clip 10 and permits direct horizontal access to the aperture with a fastener above the brick. The space created between the bricks is filled with mortar which additionally will flow into the dovetail joint to help secure the tenon clip 10 therein to the brick.

Referring to FIG. 4, for a dry stack installation where spacing is not desired, the ledge or tab section may be folded down or eliminated for a flush fit as shown in FIG. 3. Only the fastening side 16 of the tenon clip 10 will have a raised portion above the surface of the brick to allow installation via the aperture 11. Every thin brick element 1 is individually fastened to the wall structure with a tenon clip 10 and fastener passing through aperture 11. The dovetail joint functions to prevent the thin brick element 1 from pulling off the tenon clip 10 and off the vertical wall supporting structure.

A starter strip (not shown) is utilized to support the thin brick elements from below, from above or from one side. Starter strips may be straight or curved. Curved starter strips may be used to span archways and the like.

The starter strip has a support flange, a base flange depending from the support flange, preferably at a right angle, and a linking flange depending from the base flange, preferably at a right angle and preferably depending in the same direction as the support flange. Preferably, the support flange of the starter strip has one or more apertures, preferably two or more apertures, for accepting fastening means for fastening the starter strip to the structural wall. The linking flange is housed within the groove on the edge of the facing element. The linking flange preferably does not bottom-out in the groove. Preferably the base flange of the starter strip has one or more drainage holes for permitting moisture to escape from the behind the vertical wall structure.

The starter strip has a length long enough to span two or more thin brick elements. The starter strip has a length preferably from about 3 to 12 feet, more preferably about 4 or about 8 feet.

In one embodiment, the tenon clip 10 can be made by bending and cutting one single piece of metal. In one embodiment, a piece of metal with dimensions 4.25" by 2.25" can be used by way of example only. Referring to FIG. 7, bend lines at B1 form the shorter fastening side 16 (using an interior angle greater than 90 degrees). Bend lines B2 form the connecting sides 18 and split longer side 17 (bent at an interior angle of 180 degrees minus the bend angle at B1 so that the 16 and 17 are parallel). If spacing is desired, the wings 15 are made by cutting along cut line C1 from the outside edge to B2 then folded outwardly at as shown in FIG. 2. The wings can optionally be shortened to any desired length.

All common and custom bond laying patterns may be created using this system. In addition, the thin brick element and tenon clips can be installed in both a vertical and a horizontal fashion to the walls to create row-locks, headers and soldier patterns.

In one embodiment, the tenon clip 10 has a preferred depth of 2.25 inches to run the entire brick height. The lip portion above the brick is approximately 0.375 inches. The fastening side 16 of the tenon clip 10 is approximately 0.75 inches, the connecting sides 18 are approximately 1 inch each and the opposing brick side 17 is composed of two sections that extend from the connecting sides 18 of approximately 0.75 inches each with a spacing of approximately 0.25 inches in between.

The tenon clip offers versatility during installation. The installer may manipulate the tenon clip in situ in the thin brick element as required to vertically adjust the tenon clip. This is done by urging the tenon clip up or down with reference to the brick to thereby increase or decrease the spacing between vertically adjacent rows.

The tenon clip may also be shimmed with reference to the rear wall surface selectively by leaving a space between the rear of the tenon clip. In this way the thin brick element may be incrementally positioned outwardly or inwardly from the wall as required. An automatic shim feature may be provided at the rear of the tenon clip such a raised flexible indent portion or tab. As such when the tenon clip is being secured to the wall, the installer can either attach the tenon clip flush with the wall by overriding the biasing tab or incrementally depressing the tab leaving space as required. Optionally, the tenon clip may be inserted in the bottom of the brick for larger installations to prevent outwardly pivoting of the thin brick element and counter suction forces on the wall. For dry stack installation a heavier gauge may be used for the tenon clip to compensate for the lack of mortar between the adjacent vertical rows. The heavier gauge offers greater strength to compensate for the absence of mortar. As well, a plurality of tenon clips may be used to attach a single thin brick element.

Other advantages which are inherent to the structure are obvious to one skilled in the art. The embodiments are described herein illustratively and are not meant to limit the scope of the invention as claimed. Variations of the foregoing embodiments will be evident to a person of ordinary skill and are intended by the inventor to be encompassed by the following claims.

The invention claimed is:

1. A decorative wall system comprising: a supporting wall; a thin brick element having a decorative face, a top surface, a bottom surface, a thickness and a mortise formed therein; and a tenon clip having fastening means for insertion and retention within said mortise whereby said brick element is attached to said supporting wall by said fastening means;

wherein said tenon clip has a quadrilateral cross section comprising a first fastening side having a width, a second side having a width greater than the width of said first fastening side and sidewalls whereby all said sides and sidewalls are connected at the vertices;

wherein said mortise has a cross section complementary to said tenon clip cross section and is sized to receive and retain said tenon clip therein;

wherein said tenon clip has limiting means for engagement against the top surface of the brick element to limit relative movement therebetween.

2. The decorative wall system of claim 1, wherein said tenon clip and mortise cross sections are dovetail shaped.

3. The decorative wall system of claim 2, wherein said second side consists of two adjacent portions with a space therebetween and whereby said sidewalls may be pressed inwardly to collapse said space.

4. The decorative wall system of claim 3, wherein said limiting means is a tab formed integrally with said tenon clip extending outwardly from said tenon clip.

5. The decorative wall system of claim 4, wherein said tab has a vertical height above said top surface.

6. The decorative wall system of claim 5, wherein said mortise is vertically extending between said top and bottom surfaces.

7. The decorative wall system of claim 6, wherein said fastening side has an outwardly protruding collapsible shim-tab for selective engagement against said supporting wall.

8. A tenon clip for affixing brick elements to a supporting wall surface, said tenon clip having a quadrilateral cross section comprising a first fastening side having a width, a second side having a width greater than the width of said first fastening side and sidewalls whereby all said sides and sidewalls are connected at the vertices;

wherein said fastening side has aperture means for fastening the tenon clip to the supporting wall surface; and wherein said tenon clip has limiting means for engagement against the top surface of the brick element to limit relative movement therebetween.

* * * * *